United States Patent [19]

Schreder

[11] Patent Number: 5,072,096

[45] Date of Patent: Dec. 10, 1991

[54] ELECTRIC HOTPLATE

[75] Inventor: Felix Schreder, Oberderdingen, Fed. Rep. of Germany

[73] Assignee: E.G.O. Elektro-Gerate Blanc u. Fischer, Fed. Rep. of Germany

[21] Appl. No.: 496,361

[22] Filed: Mar. 20, 1990

[30] Foreign Application Priority Data

Mar. 22, 1989 [DE] Fed. Rep. of Germany ..... 3909374

[51] Int. Cl.[5] ..... H05B 3/70

[52] U.S. Cl. ..... 219/457; 219/464; 219/463

[58] Field of Search ..... 219/457, 443, 463, 464, 219/467, 458

[56] References Cited

U.S. PATENT DOCUMENTS

| | | | |
|---|---|---|---|
| 1,142,861 | 6/1915 | Van Wie | 219/463 |
| 1,177,254 | 3/1916 | Lawrence | 219/463 |
| 1,563,454 | 12/1925 | Sutherland | 219/467 |
| 1,714,175 | 5/1929 | MacInnes | 219/458 |
| 2,029,573 | 2/1936 | Knapp | 219/463 |
| 2,260,165 | 10/1941 | Calhoun | 219/463 |
| 2,422,057 | 6/1947 | Weinhardt | 219/467 |
| 2,866,071 | 12/1953 | Ruhnke . | |

FOREIGN PATENT DOCUMENTS

| | | | |
|---|---|---|---|
| 0279367 | 8/1988 | European Pat. Off. . | |
| 1818548 | 5/1955 | Fed. Rep. of Germany . | |
| 1741269 | 6/1956 | Fed. Rep. of Germany . | |
| 3514083 | 11/1985 | Fed. Rep. of Germany . | |
| 8702478 | 2/1987 | Fed. Rep. of Germany . | |
| 8712088 | 9/1987 | Fed. Rep. of Germany . | |
| 749744 | 7/1933 | France | 219/463 |
| 2191077 | 2/1974 | France . | |
| 189594 | 3/1937 | Switzerland | 219/464 |
| 191802 | 9/1937 | Switzerland | 219/457 |
| 199949 | 12/1937 | Switzerland . | |
| 228179 | 8/1943 | Switzerland | 219/464 |

*Primary Examiner*—Teresa J. Walberg

*Attorney, Agent, or Firm*—Eckert, Seamans, Cherin & Mellott

[57] ABSTRACT

An electric hotplate with a hotplate body, forming a cooking surface having a flat or shallow depression in its center, has an assembly for securing the hotplate to a hob surface and has a removable cover, such as a flat head, for providing a smooth surface at the center of the hotplate depression.

29 Claims, 2 Drawing Sheets

ELECTRIC HOTPLATE

FIELD OF THE INVENTION

The invention relates to an electric hotplate with a hotplate body forming a cooking surface with a flat or shallow depression in the center.

So as to obtain a closed surface in at least portions of the top, while bringing about an adequate hotplate body stability, the invention proposes that the underside of the hotplate body is profiled and is substantially closed in the center.

of the invention is to avoid the disadvantages of the prior art and in particular to provide in the center of the depression an arrangement through which at least said center can be provided in simple manner with a much smoother surface than the surrounding areas.

According to the invention this object is achieved in the case of an electric hotplate of the aforementioned type in that means are provided, so that that area of the hotplate body, in which the latter has on the underside at least one e.g. stud-like projection, can be provided with a cover member, such as a flat head or the like. The flat head can be made for a different material from the hotplate body and in particular from steel, such as stainless steel and on the top has a surface with a considerably smaller roughness than the hotplate body, e.g. a surface like that of a profiled surface.

It is particularly advantageous if the said cover is easily detachable, but can be secured in the operating state, so that it can be removed from the hotplate surface or replaced at any time with the said of a removal tool, screw-driver-like tool or the like.

Another important advantage of the invention is that the cover member can cover at least an opening in the top of the hotplate body which is provided for functions other than the reception of the cover, e.g. as an assembly opening, an expansion compensating opening, etc., and preferably extends into the projection or even traverses the same to its lower end. The opening, which is in particular in the form of a bore, can be a blind bore, a countersink-free through-bore, a through-bore with a countersink at the upper end, a thread-free bore over its entire length, a threaded bore over its entire length, a through-bore with a threaded portion, a stepped bore, a bore arrangement of two substantially aligned blind bores ending close to one another, or the like. The bore or bores can be provided for the reception of at least two separate studs and at least one stud can be arranged in completely contact-free manner with respect to the hotplate body, e.g. in a bore provided on a component separate from said body.

According to a preferred embodiment the cover is provided for the upper end face of the head of a clamping bolt insertable and mountable or tightenable from the top of the hotplate body or the cooking surface and which e.g. has an engaging member for a screwdriver-like tool, e.g. a hexagonal recess, a cross-slot, an intersecting slot depression, etc. After releasing the cover the clamping bolt is freely accessible from the top, so that the hotplate can be loosened or removed from a hob at any time, and optionally replaced.

The cover can also be directly formed by the clamping bolt head or can form therewith a one-part component, e.g. in such a way that in the top of one of said engagement members for a tool, the cover has in particular an intersecting slot depression. The lower, externally threaded shank end of the clamping bolt appropriately engages in a clamping member located on the underside of the hotplate body such as a cross-clip, an undershell, etc., which can be supported adjacent to the outer circumference of the electric hotplate on the underside of the hob and is preferably so clamped by the clamping bolt against the underside of the projection of the hotplate body that also a lower end plate for the hotplate body can be clamped against said underside by interposing.

According to the invention in the case of an electric hotplate of the aforementioned type or some other type, a clamping bolt or similar clamping part is proposed, which essentially traverses the hotplate body, but is operable from the underside thereof in that it has at its lower end an engaging member for a tool, e.g. one of the engaging members essentially located within its outer circumference. It is also conceivable to provide such an engaging member on the outer circumference, e.g. in the form of a polygon. A particularly advantageous further development is obtained if the clamping bolt is operable from both the top and bottom of the hotplate body by arranging identical or different engaging members on both ends, because tools can not only then be fitted to each of the two ends of the clamping bolt, but e.g. in the case of a particularly firmly seated clamping bolt, tools can be simultaneously fitted at both ends, so that the engaging members can be made relatively weak or small.

If the hotplate body is constructed in such a way that the clamping bolt can also be inserted on the underside, then for reception in the hotplate body it is possible to provide a through-bore, whose upper end is then closed in simple manner by the cover. In this case the clamping bolt can also have one of the said engaging members at its upper shank end.

However, if a threaded blind bore is provided for the clamping bolt to be inserted from the bottom then, for fixing the cover there is appropriately provided in the top of the hotplate body a bore, such as a blind bore which is separate from said threaded bore or is completely closed with respect thereto and into which can be inserted a stud projecting from the underside of the cover. However, this stud can also so engage, e.g. with press fit in a corresponding bore in the head or shank end of the clamping bolt, that on loosening the latter the cover or stud is also loosened. An arrangement can be provided in which the cover is mounted after inserting and tightening the clamping bolt, but can be released simultaneously with said bolt or by loosening the latter. The external diameter of the stud or in the case of a cylindrical construction its diameter is preferably smaller than half the external diameter of the cover which is not made from sheet metal, but instead has solid sections, so that favorable cross-sections with respect to thermal loads are also obtained.

The cover can substantially exclusively directly engage on the bottom of the upper, central depression of the hotplate body and/or it can at least partly engage in a countersunk depression provided in said bottom surface, so that the height of the cover can be roughly the same as the depth of the depression, without there being any risk of the top of the cover extending up to the plane of the cooking surface or projecting above the same. However, the cover can e.g. be countersunk in such a way that its top forms a substantially continuous and uninterrupted extension of the bottom surface of the depression. In this case the central area of the depression must be well cleaned.

Moreover, according to the invention, in the case of an electric hotplate of-the described or a similar type, it is proposed that the depression-forming, particularly substantially flat or shallow, frustum-shaped wall of the hotplate body has on the underside at least one flattened portion roughly parallel to the cooking surface and which is preferably connected to the outer circumference of the central projection of the hotplate body and/or is radially spaced from a downwardly projecting, inner flanged ring of the hotplate body located in the vicinity of the outer circumference of said wall and which can surround the inner circumference the heated area of said body. This flattened portion can be used for the engagement of the head or switch casing of a temperature switch having a temperature sensor, such as a temperature limiter, or some similar, separate constructional group and ensures a reliable and precisely oriented support.

BRIEF DESCRIPTION OF THE DRAWINGS

These and further features of the preferred developments of the invention can be gathered from the claims, description and drawings. Individual features can be realised in an embodiment of the invention and in other fields either alone or in the form of subcombinations and can represent advantageous, independently protectable constructions, for which protection is here claimed. The invention is described hereinafter relative to embodiments and the attached drawings, wherein:

DETAILED DESCRIPTION OF THE PREFERRED EMBODIMENTS

Figure 1:
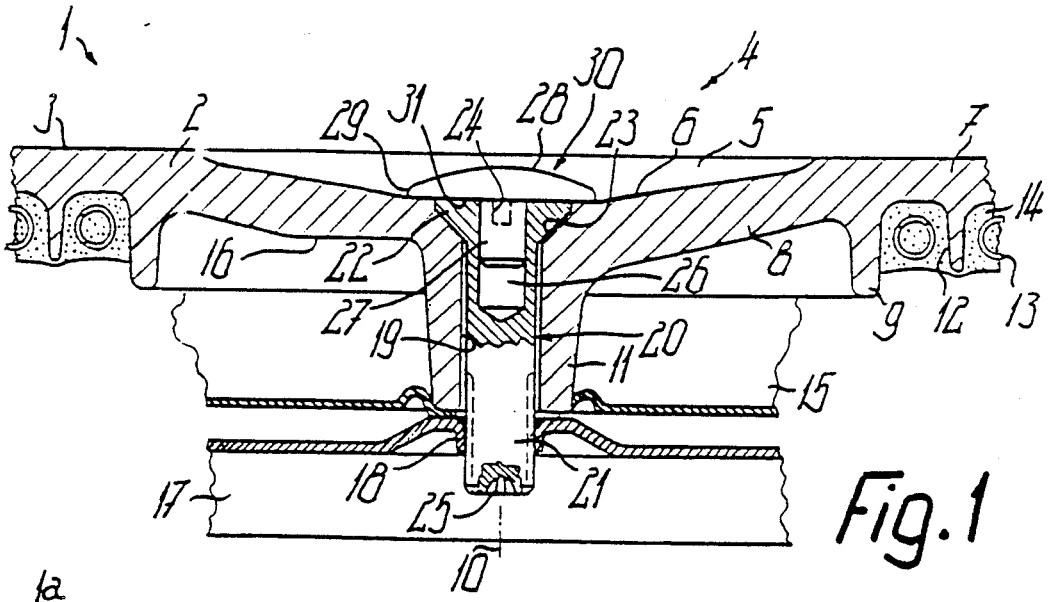
FIG. 1 shows a central detail of an inventive electric hotplate in the fitted state and in axial section.

The electric hotplate 1 according to FIG. 1 has a preferably cast metal hotplate body 2, which forms on its top a planar, circular cooking surface 3 and a central zone 4, which is slightly lower than the cooking surface 3 and which is surrounded by the latter. In the vicinity of the central zone 4, the hotplate body is not directly provided with an electrical heating system. The central zone 4 is in the form of a shallow depression 5 substantially continuously rising to its outer circumference and having a flat shell-like base surface 6, which is only substantially planar in its central area.

A circular, inner flanged ring 9 projects downwards on the underside of hotplate body 2 and surrounds at the inner circumference the heated area of said body 2. The heated area on the outercircumference can be bounded by a not shown, outer, but further downwardly projecting flanged ring. The hotplate body 2 is substantially symmetrical to a central axis 10 at right angles to its cooking surface 3 and can be bounded at the outer circumference in circular, rectangular or similar manner.

Past the underside of the hotplate body 2 projects a projection 11 located in the central axis and spaced within the flanged ring 9 and which is in the form of a center stud tapering downwards in acute-angled manner and which is used for fixing the electric hotplate in the fitting opening of a not shown hob and on whose opening rim body 2 is mounted with a not shown bearing ring. Projections 11 is constructed in one piece with the hotplate body 2.

In the radially outside area connected to the flanged ring 9, the hotplate body 2 forms a ring plate-like wall 7 and in the area located radially within the flange ring 9 a shallow frustum-shaped wall 8, whose top forms the base surface 6 and whose bottom is frustum-shaped like the top, so that over most of its circumference wall 8 has a substantially constant thickness. Projection 11 projects downwards from the bottom of wall 8. In the bottom of wall 7 is provided at least one spiral groove 12 substantially parallel to the cooking surface 3 and whose innermost turn is bounded by the flanged ring 9.

A helical heating resistor 13 is inserted in contact-free manner in each spiral groove 10 and is embedded in a molded insulating material 14. However, it is also possible to use a tubular or similar heater for heating purposes. On the underside the hotplate body 2 is closed with an e.g. sheet metal end plate 15, which can be supported in not shown manner on the outer flanged ring in radially outer region and in the central region appropriately engages on the lower, planar face of projection 11 spaced below the flanged ring 9.

In at least one part of its circumference, wall 8 is provided on the underside with a flattened portion which forms a bearing surface 16 roughly parallel to the cooking surface 3 and to whose further upward area is connected the raised outer circumference of projection 11 in the vicinity of the transition between the planar center and the rising part of base surface 6 and only extends over part of the radial extension of wall 8. The radial extension of bearing surface 16 roughly corresponds to half the spacing between the outer circumference of projection 11 and flanged ring 9, so that the bearing surface 16 at its radially outer boundary passes into the rising portion of the bottom of wall 8.

For fixing the electric hotplate 1 to the hob a clamping part 17 formed by a cross-sectionally U-shaped clip is located directly below the hotplate body 2 and is supported on the underside of the hob with upwardly directed ends outside the outer circumference of the body 2 in the vicinity of the edge of the mounting opening. The clamping part can also be formed by a tray-like depression in the hob. With its profile cross-leg, said clamping part 17 forms a downwardly freely projecting threaded sleeve 18 located in the central axis 10 for receiving the shank 21 of a clamping bolt 20, which traverses a thread-free through-bore 19 of projection 11. The head 22 of clamping bolt 20 having a frustum-shaped face following onto the shank 21 is substantially completely countersunk in a corresponding frustum-shaped countersunk bore 23 forming the upper end of through-bore 19. Preferably the upper face of the bolt head 22 extends at the most up to the plane of base surface 6 or is located in the plane of the central area of said surface 6, so that it forms a continuous extension thereof. A tool engaging member 24, e.g. in the form of a diagonal groove is provided in the upper face of clamping bolt 20 or bolt head 22. A corresponding tool engaging member 25, e.g. formed by an intersecting slot depression is provided on the other end of the clamping bolt 20, namely in the lower face of shank 21, which projects over the threaded sleeve 18 and which is freely accessible from below.

The bolt head 22 or its upper face is covered by a flat head 30, which projects radially outwards over the outer circumference of head 22 and at least in the vicinity of its outer circumference engages in uninterrupted manner on base surface 6. The external diameter of the flat head 30 is substantially the same as the central, planar area of base surface 6. From the upper face of the bolt head 22 passes a blind bore 26, which is longer than its axial extension and which is located in the central axis, the diameter of bore 26 being greater than half the diameter of the bolt shank 21 or the through-bore 19. A stud 27, shorter than the blind bore 26 engages therein with press fit and is constructed in one piece with the flat head 30 and projects from its lower face 31. The upper face 28 of flat head 30 is continuously convex from its outer circumference 29 to the central axis 10, e.g. it is curved with a radius of curvature which is larger than the external diameter of flat head 30 and is in particular roughly 50% larger. The outer circumference 29 of the flat head 30 is cross-sectionally curved with a relatively small radius of curvature, so that in the transition region to the lower face 31 is forms a small undercut, in which can be engaged a removal tool. For the engagement of the latter it is also possible to provide small notches or the like on the outer circumference of flat head 30. Due to the fact that the clamping bolt 20 has on the lower end an engaging member 25, it is possible to draw out upwards bolt 20, including the flat head 30 firmly connected thereto to such an extent that the lower face 31 of flat head 30 is accessible for fitting a removal tool. The upper face 28 of flat head 30 is at a limited distance below the plane of cooking surface 3.

In the central area of the middle zone 4 or the depression 5, flat head 30 forms an easily detachable cover, which has a readily accessible, substantially gap-free or uninterrupted and completely closed surface and whose external diameter is roughly 33% larger than the external diameter of the bolt head 22, but is roughly only 33% of the external diameter of depression 5. The lower face 31 of flat head 30 can slightly rise towards its center, so as to ensure reliable engagement in the vicinity of the outer circumference or it can be made precisely planar. According to FIG. 1 it engages both on the upper face of bolt head 22 and on the base surface 6, whereby it covers the annular clearance between these two surfaces.

In FIGS. 2 to 6 corresponding parts are given the same reference numerals to FIG. 1, but are followed by corresponding letters, so that the corresponding description parts apply to all the drawings. Individual features can also be interchanged between the different embodiments, which leads to further embodiments.

Figure 2:
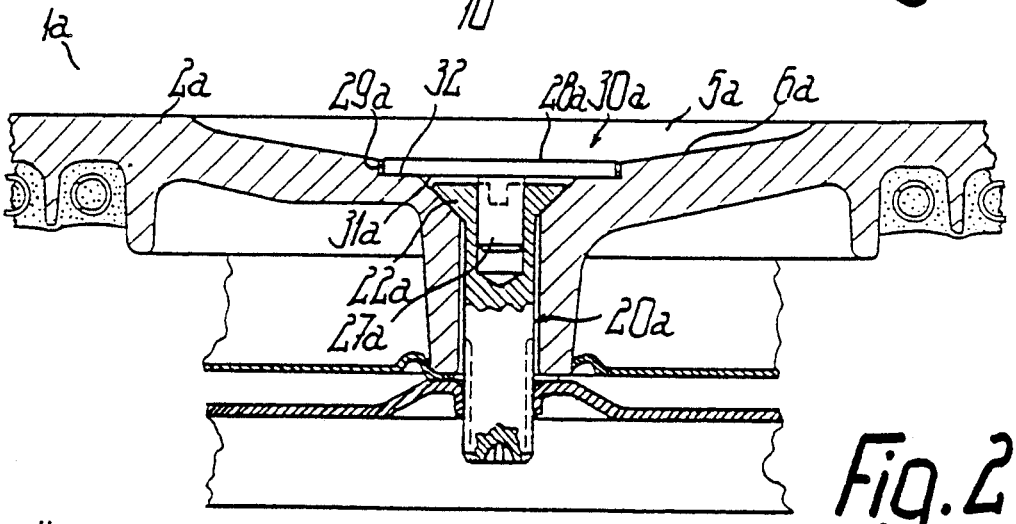
FIGS. 2 to 6 show further embodiments in views corresponding to FIG. 1.

In the case of the electric hotplate la according to FIG. 2, the bottom surface **6*a* of depression 5*a* contains a counter-sunk depression 29*a* adapted to flat head 30*a* and which is connected with a ring shoulder to the countersunk bore for bolt head 22*a*. The depth of the countersunk depression 32 roughly corresponds to the thickness of the flat disk-like flat head 30*a*, which is in this case provided with a substantially planar, upper face 28*a*, whose thickness is between 1 and 2 mm. Outer circumference 29*a* is cylindrical over the entire thickness of the flat head 30*a* and is closely adapted to the outer circumference of the counter-sunk depression 32. thus, the upper face 28*a* forms the planar center of base surface 6*a*. The lower face 31*a* of flat head 30*a* is located at a limited distance above the top of bolt head 22*a***.

Figure 3:
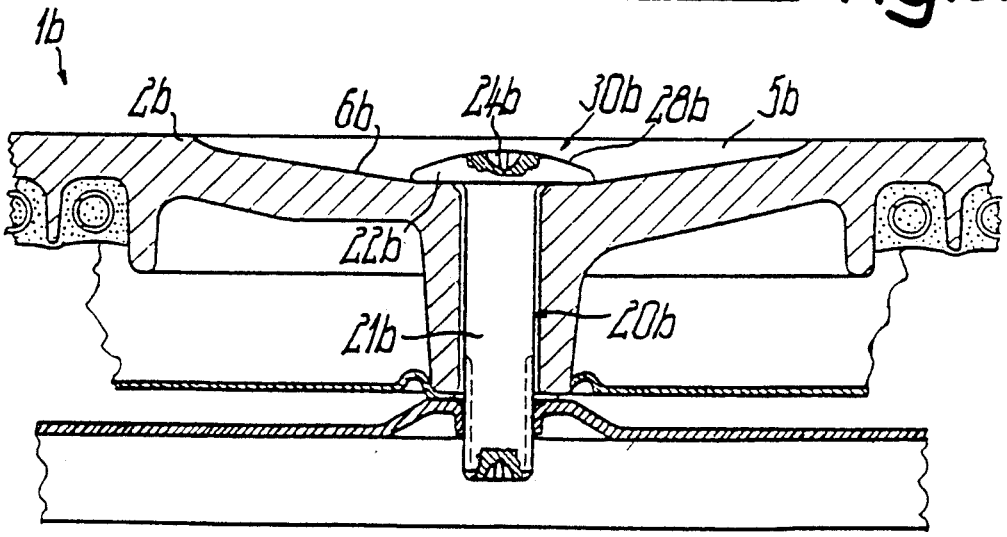

As shown in FIG. 3, the flat head **30*a* can also be directly formed by the bolt head 22*b*, so that its stud is formed by the bolt shank 29*b*. In the upper face 28*b* of flat head 30*b* is appropriately provided a tool engaging member 24*b***, which is in this case formed by an intersecting slot depression and which can optionally be filled with a filling material removable e.g. as a result of destruction.

Figure 4:
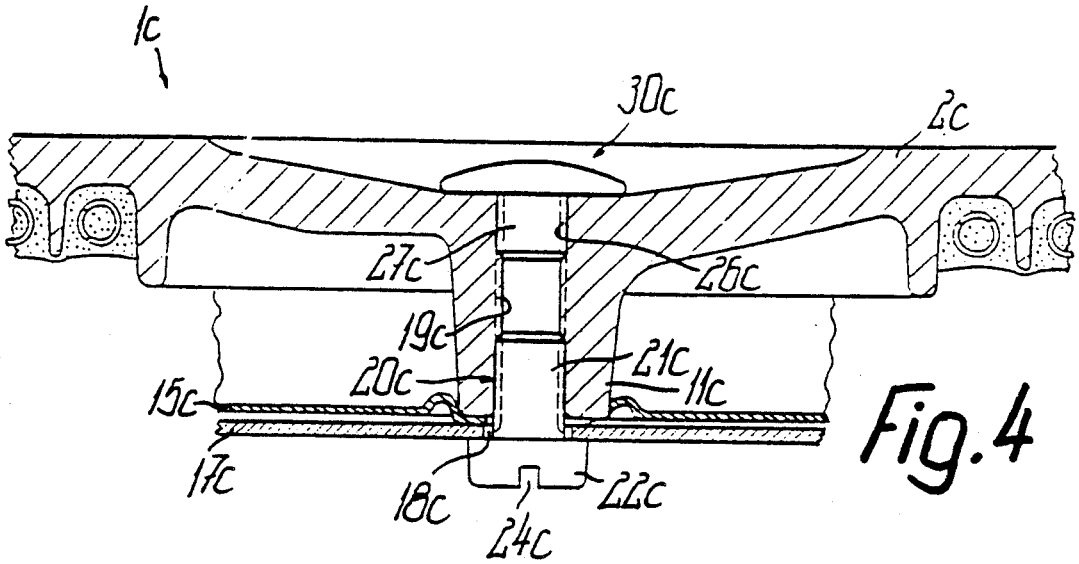

The flat head **30*c* according to FIG. 4 can also have such a tool engaging member. In this case the through-bore 19*c* is constructed as a threaded bore over its entire length, its upper end portion forming the threaded reception bore 26*c* for the stud 27*c* of flat head 30*c* constructed as a threaded shank. Thus, head 30*c* is fixed by screwing in and released by unscrewing and in the screwed in state it essentially only serves for the closed covering of the through-bore 19*c*. The clamping bolt 20*c* is screwed from below into the through-bore 19*c* of projection 11*c*, so that its head 22*c* clamps the clamping part 17*c* against projection 11*c* and the shank 21*c* traverses a through-bore 18*c* in clamping part 17*c*. In this case the clamping part 17*c* is formed by a tray substantially covering the underside of hotplate 1*c* and whose substantially planar tray bottom is directly located below the end plate 15*c* and is traversed by the clamping bolt 20*c*. The stud 27*c* is significantly shorter than the bolt shank 21*c***.

Figure 5:
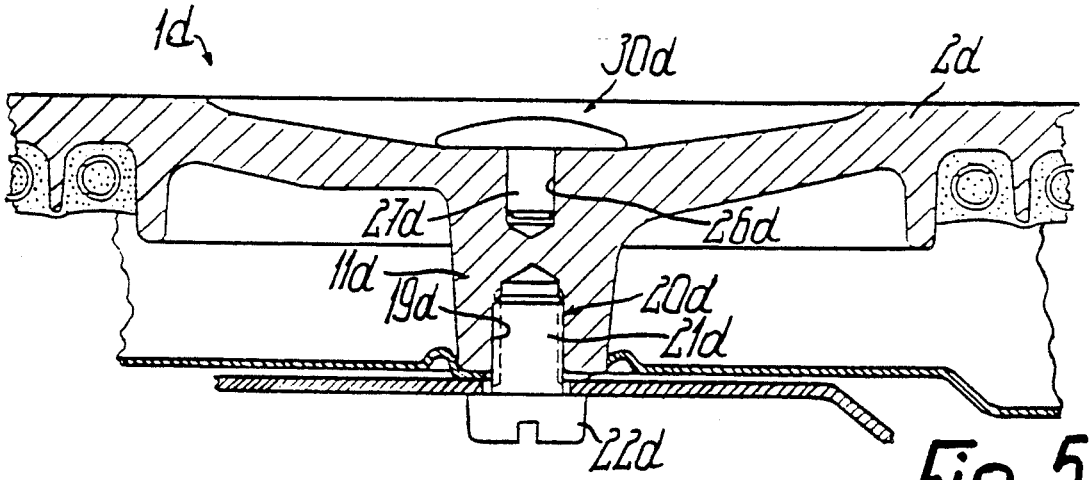

In FIG. 5 the clamping bolt **20*d* is arranged in substantially the same way as in FIG. 4, but is screwed into a threaded blind bore 19*d* at the lower end of the projection 11*d*. The stud 27*d* of flat head 30*d* engages in a blind bore 26*d* of hotplate body 2*d* which is equiaxial to said blind bore 19*d*. Blind bore 26*d* has a roughly 33% smaller diameter than blind bore 19*d*. The facing ends of the two blind bores 19*d*,26*d* have a spacing from one another which is smaller than the diameter of each of the two blind bores. Thus, projection 11*d*** has a bore-free longitudinal portion with solid sections.

Figure 6:
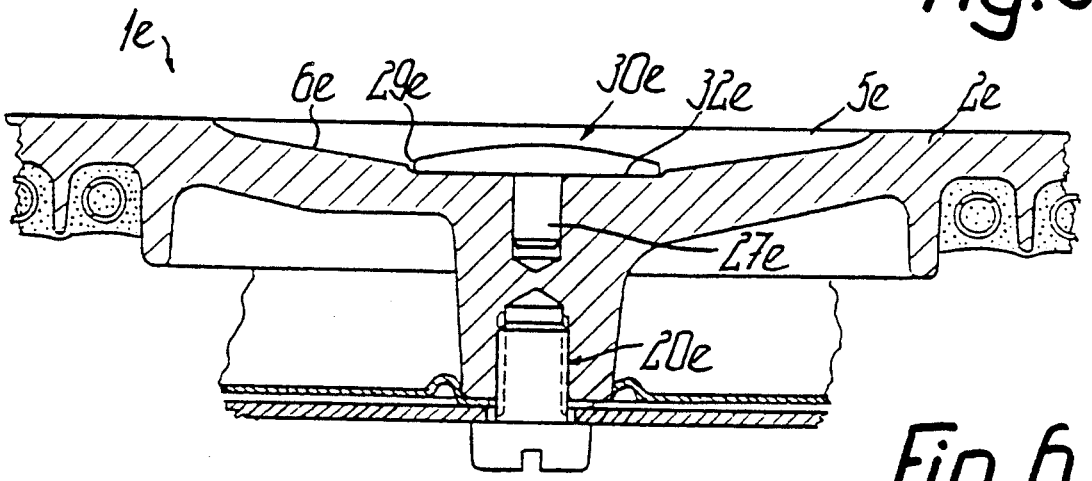

In the case of the electric hotplate according to FIG. 6 the bottom surface **6*e* of the depression 5*e* contains a very shallow countersunk depression 32*e*, whose depth is equal to or smaller than the height of the rounded outer circumference 29*e* of flat head 30*e*. Thus, at least over part of its height, said outer circumference 29*e* is shielded. Otherwise the clamping bolt 20*e* and stud 27*e* are arranged in substantially the same way as in FIG. 5**.

I claim:

1. An electric hotplate comprising:

a hotplate body providing an underside and having a substantially central projection on said underside; a heating surface providing a plane and a center zone having a flat shallow depression below said plane, said center zone receiving a flat heat and slopingly rising to an outer circumference from said head, said center zone being centrally penetrated by a bore, said central projection receiving at least one shank, said at least one shank being provided by a fixing device for clamping said hotplate against a hob, wherein said flat head covers said depression radially outside of said bore and at a distance radially inside of said outer circumference of said depression, thereby covering an upper surface of said fixing device.

2. The electric hotplate according to claim 1, wherein only an upper end of said bore is associated with said flat head, said fixing device having at least one tool engaging member for tightingly operating a fixing bolt with respect to said hotplate body for clamping said hotplate against said hob.

3. The electric hotplate according to claim 1, wherein said flat head is only fixed by means of a plug-in connection provided by said at least one shank and a plug bore of smaller cross-sectional width than said flat head.

4. The electric hotplate according to claim 1, wherein said flat head is only fixed by means of a threaded connection providing a threaded portion of said hotplate body.

5. The electric hotplate according to claim 1, wherein an external width extension of said flat head is substantially the same as a largest external width extension of said projection of said hotplate body, said projection being a center stud receiving said fixing device and extending from a shallow frustrum-shaped bottom wall of said depression.

6. The electric hotplate according to claim 1, wherein said flat head is circular and has a diameter substantially equal to an associated planar section of said depression.

7. The electric hotplate according to claim 1, wherein on an underside, said flat head has a stud at least partially constructed in one piece with said flat head and engaging substantially into said projection, said flat head in cross section being substantially solid, an underside face of said flat head covering an annular clearance gap between said fixing device and said depression.

8. The electric hotplate according to claim 1, wherein a stud of said flat head has a largest external diameter substantially smaller than half an external width extension of at least one of members provided by said flat head and said projection, said stud being shorter than said bore.

9. The electric hotplate according to claim 1, wherein a stud of said flat head has substantially constant external diameters over an entire length extension shorter than said bore.

10. The electric hotplate according to claim 1, wherein said fixing device for fixing said hotplate body to the hob is provided at least in an area below said flat head, said fixing device comprising a clamping bolt with a tool engagement head portion and said flat head having an external width extension larger than a corresponding width extension of said head portion.

11. The electric hotplate according to claim 10, wherein said fixing device is located substantially in a central axis of said flat head, said head portion being a widened section of said shank.

12. The electric hotplate according to claim 1, wherein said fixing device has a clamping bolt for engaging in said bore said bore providing a through hole bore in said projection, said clamping bolt bearing said flat head, said flat head circumferentially connecting to a shallowly rising section of said depression.

13. The electric hotplate according to claim 1, wherein said flat head is a component separate from an enlarged head portion of said fixing device, a stud of said flat head being directly connected and in engagement with said fixing device.

14. The electric hotplate according to claim 1, wherein said flat head at least partially provides an upper cover for covering a separate bolt head substantially countersunk into a base surface of said depression, said bolt head having means for being operated by a tool.

15. The electric hotplate according to claim 14, wherein said bolt head is part of a clamping bolt at least partly traversing said hotplate body, said bolt head having said means in an end face covered by said flat head.

16. The electric hotplate according to claim 1, wherein said flat head is provided with a tool engaging member and has in one part a clamping bolt for clamping said hotplate body against the hob, said clamping bolt at least partly traversing said hotplate body, said tool engagement member being a reception opening for receiving a destructionally removable filling material.

17. The electric hotplate according to claim 1, wherein said flat head is located substantially entirely on a top of a planar base surface of said depression, said base surface connecting to a shallowly rising section substantially wider than an outer circumference of said flat head.

18. The electric hotplate according to claim 1, wherein said flat head is a component separate from said fixing device and engages with a stud in an upper end of a bore unit of said hotplate body, a lower end of said bore unit being provided for engaging by receiving a clamping bolt of said fixing device, said clamping bolt being operable from the underside of the hotplate.

19. The electric hotplate according to claim 18, wherein said bore unit is a through bore traversing said projection and constructed to receive two opposed studs.

20. The electric hotplate according to claim 1, wherein said flat head engages with a stud in a blind bore inside the hotplate body.

21. The electric hotplate according to claim 1, wherein said fixing device has a tool engaging member on a free end of a bolt shank, said free end being located remote from said flat head and said tool engagement member being provided for operating said fixing device.

22. The electric hotplate according to claim 1, wherein said flat head has a flat, convex lense shaped upper face extending substantially up to a center, an outer circumference of said flat head being rounded in cross-section with a smaller radius of curvature than said upper face, said upper face having a radius of curvature substantially larger than an outer diameter of said flat head.

23. The electric hotplate according to claim 1, wherein said flat head is a flat member having a substantially planar, upper face extending substantially up to a largest external circumference provided by a substantially cylindrical outer circumferential surface extending over an entire thickness extension of said flat head.

24. The electric hotplate according to claim 1, wherein an underside face of said flat head is at least partly located in a height level substantially equal to a base surface of said depression, an outer circumference of said flat head substantially directly connecting to a shallowly rising section of said base surface.

25. The electric hotplate according to claim 1, wherein an underside face of said flat head is at least partly located below a base surface of said depression in a countersunk depression closely adapted to said flat head, an upper face of said flat head providing a center section of said depression, said upper face directly connecting to a shallowly rising section of said base surface.

26. The electric hotplate according to claim 1, wherein a top side of said flat head provides a substantially continuous continuation of a base surface of said depression, said depression cross-sectionally rising from an outer circumference of said flat head.

27. An electric hotplate comprising:

a hotplate body providing an underside and having a substantially central projection on said underside; a heating surface providing a plane and a center zone having a flat shallow depression;

a flat head substantially in a center of said depression and substantially aligned with said projection, said flat head extending at the most up to said plane of said heating surface, wherein said flat head at least partially provides an upper cover for a bolt top head substantially counter-sunk into a base surface of said depression, said flat head engaging with a stud in a frontal bore of said top head.

28. An electric hotplate comprising:

a hotplate body providing an underside and having a substantially central projection on said underside;

a heating surface providing a plane and a center zone having a flat shallow depression; and a flat head substantially in a center of said depression and substantially aligned with said projection, said flat head extending at the most up to said plane of said heating surface, wherein said flat head engages with a stud in a blind boil, said stud having a smaller external diameter than a substantially aligned clamping bolt for said hotplate body.

29. An electric hotplate comprising;

a hotplate body providing an underside and having a substantially central projection on said underside;

a heating surface providing a lane and a center zone having a flat shallow depression; and a flat head substantially in a center of said depression and substantially aligned with said projection, said flat head extending at the most up to said plane of said heating surface, wherein said flat head with a stud and a clamping bolt for said hotplate body engage in separate and substantially equiaxial blind bores of said hotplate body.

* * * * *

UNITED STATES PATENT AND TRADEMARK OFFICE

CERTIFICATE OF CORRECTION

PATENT NO. : 5,072,096

DATED : December 10, 1991

INVENTOR(S) : SCHREDER

It is certified that error appears in the above-identified patent and that said Letters Patent is hereby corrected as shown below:

Column 1, line 13, before "of the" insert --An object--.
line 32, replace "said" with --aid--.
Column 5, line 60, replace "thus," with --Thus,--.
Column 7, line 45, delete "hole".
Column 10, line 6, replace "lane" with --plane--.

Signed and Sealed this

Fifteenth Day of June, 1993

*Attest:*

Michael K. Kirk

MICHAEL K. KIRK

*Attesting Officer*

*Acting Commissioner of Patents and Trademarks*